US007731105B2

(12) United States Patent
Lishanski et al.

(10) Patent No.: US 7,731,105 B2
(45) Date of Patent: Jun. 8, 2010

(54) VIBRATORY PUMP WITH ADAPTER AND HIGH PRESSURE MECHANISM

(76) Inventors: Grigori Lishanski, 11006 N. Balsam Tree Ct., Mequon, WI (US) 53092; Oleg Lishanski, 747 Alsace Cr., Buffalo Grove, IL (US) 60089

( * ) Notice: Subject to any disclaimer, the term of this patent is extended or adjusted under 35 U.S.C. 154(b) by 664 days.

(21) Appl. No.: 11/371,137

(22) Filed: Mar. 8, 2006

(65) Prior Publication Data

US 2007/0212241 A1 Sep. 13, 2007

(51) Int. Cl.
*B05B 9/04* (2006.01)
*B05B 15/00* (2006.01)
*B05B 17/00* (2006.01)

(52) U.S. Cl. ..... 239/332; 239/289; 239/319; 239/331

(58) Field of Classification Search ..... 239/102.1, 239/289, 302, 319, 321, 329, 331–333, 330; 417/415, 416; 222/333
See application file for complete search history.

(56) References Cited

U.S. PATENT DOCUMENTS 2,038,155 A * 4/1936 Aldridge ..... 417/491
4,162,037 A * 7/1979 Koyama ..... 239/332
5,150,841 A * 9/1992 Silvenis et al. ..... 239/332
5,716,007 A * 2/1998 Nottingham et al. ..... 239/332
6,315,533 B1 * 11/2001 Lishanski et al. ..... 417/545
6,364,622 B1 * 4/2002 Lishanski et al. ..... 417/53
6,398,081 B2 * 6/2002 Bassi et al. ..... 222/333
6,428,289 B1 * 8/2002 Lishanski et al. ..... 417/415
6,604,920 B1 * 8/2003 Lishanski et al. ..... 417/491
7,318,539 B2 * 1/2008 Vitantonio et al. ..... 222/333
7,354,255 B1 * 4/2008 Lishanski et al. ..... 417/491
2003/0173420 A1 * 9/2003 Hanson ..... 239/337
2003/0201340 A1 * 10/2003 Hanson ..... 239/332
2004/0129801 A1 * 7/2004 Hanson ..... 239/332

* cited by examiner

*Primary Examiner*—Darren W Gorman
(74) *Attorney, Agent, or Firm*—Boyle Fredrickson S.C.

(57) ABSTRACT

The present invention is a vibratory pumping apparatus that increases the ease and effectiveness of use of the apparatus. More specifically, the apparatus includes an adapter engageable with a conventional motive member, such as an electric drill, in order to enable the apparatus convert the rotational motion of the motive member into oscillatory motion for the pump, such that the pump can be operated using any number of different motive members. In addition, the mechanism within the apparatus is formed of a pair of piston-like members that operate in conjunction with one another to increase the pressure at which the fluid pumped by the mechanism is dispensed from the apparatus.

9 Claims, 7 Drawing Sheets

VIBRATORY PUMP WITH ADAPTER AND HIGH PRESSURE MECHANISM

FIELD OF THE INVENTION

The present invention is related to pumps, and more specifically to a pump capable of using a vibratory or oscillating motion in order to pump a fluid at a desired rate and pressure.

BACKGROUND OF THE INVENTION

With regard to the pumping of fluids, a wide range of fluid pumping devices have been developed in order to meet this need. However, with regard to certain situations, the prior art pumping mechanisms do not provide the range of pumping pressures desired with a minimum of expense desired with such devices.

Thus, a number of vibratory pump mechanisms have been developed, which are disclosed in U.S. Pat. Nos. 6,315,533; 6,364,622; 6,428,289; and 6,604,920, and U.S. patent application Ser. Nos. 10/863,713 and 11/063,677, each of which are herein incorporated by reference in their entirety, in order to provide a pumping mechanism which provides the wide range of fluid pumping flow rates with a low cost and adaptable mechanism. Nevertheless, it is desirable to further improve upon these vibratory pump mechanisms in order to increase their usefulness and efficiency over a wide range of potential uses, particularly with respect to their ability to be utilized with readily available motive mechanisms and to dispense fluids at high pressures

SUMMARY OF THE INVENTION

According to one aspect of the present invention, an improved vibratory pumping mechanism is disclosed in which the mechanism includes a chamber is which the fluid pumping mechanism and fluid to be pumped are located that can be easily connected to an existing motive mechanism, such as a drill. The pumping mechanism includes an adapter operably connected to the oscillating shaft of the pumping mechanism. The adapter includes a rotatable member engageable with a rotating component or member disposed on the motive mechanism and connected to a transfer rod. The transfer rod is pivotably connected to the rotatable member at one end, and to a hinge at the opposite end. The hinge is connected between a transfer rod and an oscillating rod such that the rotation of the rotating member can be transmitted along the transfer rod and hinge to the oscillating member such that the oscillating rod moves in a generally vertical oscillating manner when the rotatable member is rotated due to its connection to the rotating member. Thus, through utilizing the adapter, the pumping mechanism can be operably connected to a wide range of existing motive mechanisms, such as electric drills, for use therewith.

According to another aspect of the present invention, the pumping mechanism is formed with a pair of aligned fluid dispensing members that increase the pressure at which a fluid dispensed by the mechanism is discharged. The fluid dispensing members are spaced from one another, such that one of the members is located outside of the outlet chamber for the mechanism and the other member is located within the outlet chamber, thereby creating two separate pressure generating mechanisms within the single pumping mechanism.

Numerous other aspects, features and advantages of the present invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
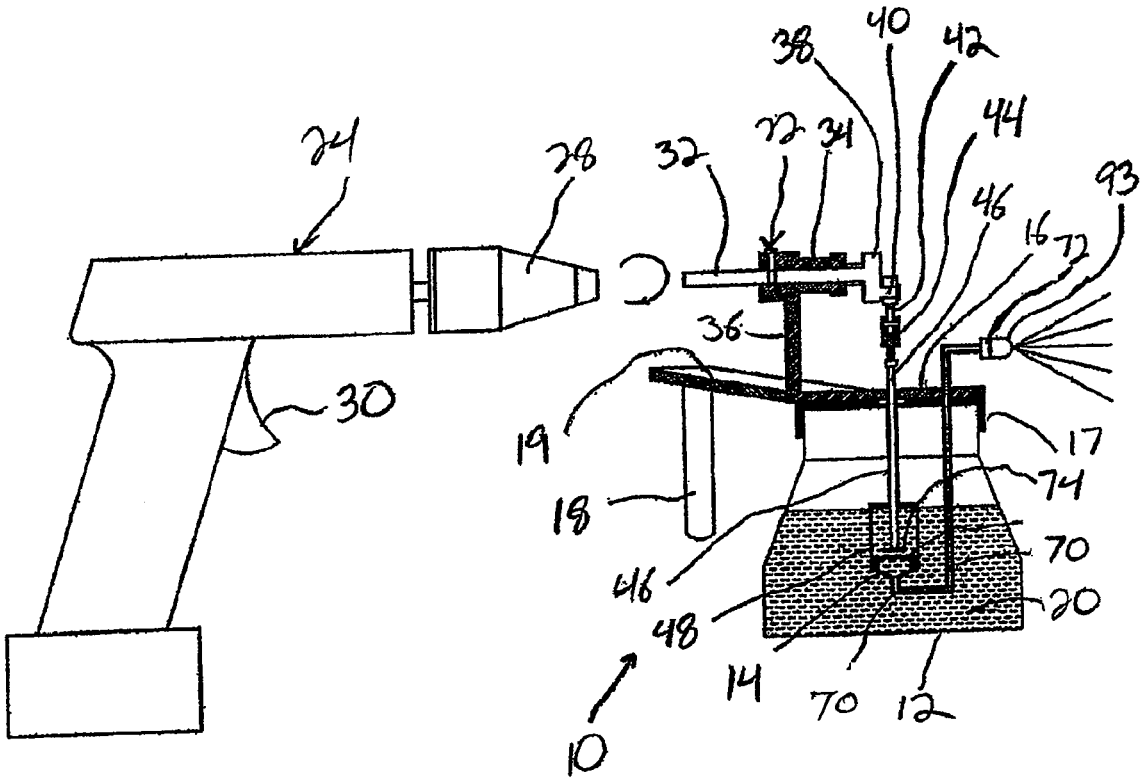
FIG. 1 is a cross-sectional view of a pumping apparatus constructed according to the present invention.

With reference now to the drawing figures in which like reference numerals designate like parts throughout the disclosure, a pumping apparatus is indicated generally at 10 in FIG. 1. The apparatus 10 includes a container 12 within which is disposed a pumping mechanism 14 and on which is secured a cover 16, such as by a threaded collar 17. The cover 16 includes a handle 18 at one end 19 and serves to selectively retain a fluid 20 to be pumped by the mechanism 14 within the container 12. The cover 16 also supports an adapter 22 utilized to operably connect the pumping mechanism 14 with a motive member 24. The motive member 24 in a preferred embodiment can take the form of an electric drill 26 including a manually engagable chuck 28 and an operating trigger 30 and that is operated by a battery (not shown) or a plug 31 (FIG. 3) connectable to a conventional power outlet (not shown), as is known in the art. The chuck 28 is engageable with a rotating shaft 32 rotatably positioned within a housing 34 affixed to the cover 16 by a support 36. The shaft 32 is rotatably mounted within the housing 34 and extends outwardly from each end of the housing 34. One end of the shaft 32 is releasably engageable within the chuck 28 for rotation therewith, and the opposite end of the shaft 32 terminates in a circular member 38 from which extends a pin 40 which is pivotably secured to a transfer shaft 42. The circular member 38 is secured to the shaft 32 adjacent the outer circumference of the circular member 38 so that the circular member 38 rotates in a generally eccentric manner with regard to the shaft 32. In turn, the pin 40 causes the transfer shaft 42 to oscillate in an upward and downward manner along with the rotation of the circular member 38. Opposite the pin 40, the transfer shaft 42 is connected to a hinge 44 that is secured opposite the transfer shaft 42 to an oscillating shaft 46 of the pumping mechanism 14. The pivoting of the hinge 44 enables a certain amount of lateral movement of the transfer shaft 42 with respect to the oscillating shaft 46, while effectively transferring the rotation of the circular member 38 to the oscillating shaft 46 in a manner which causes the shaft 46 to move in a strictly vertically oscillating manner in order to operate the mechanism 14.

The ability of the adapter 22 to simply and easily convert rotary motion to vertical oscillating motion enables the pumping mechanism 14 to be releasably secured to a number of motive members 24 having various configurations such that the pumping mechanism 14 can be utilized in conjunction with a variety of motive members 24.

Figure 2:
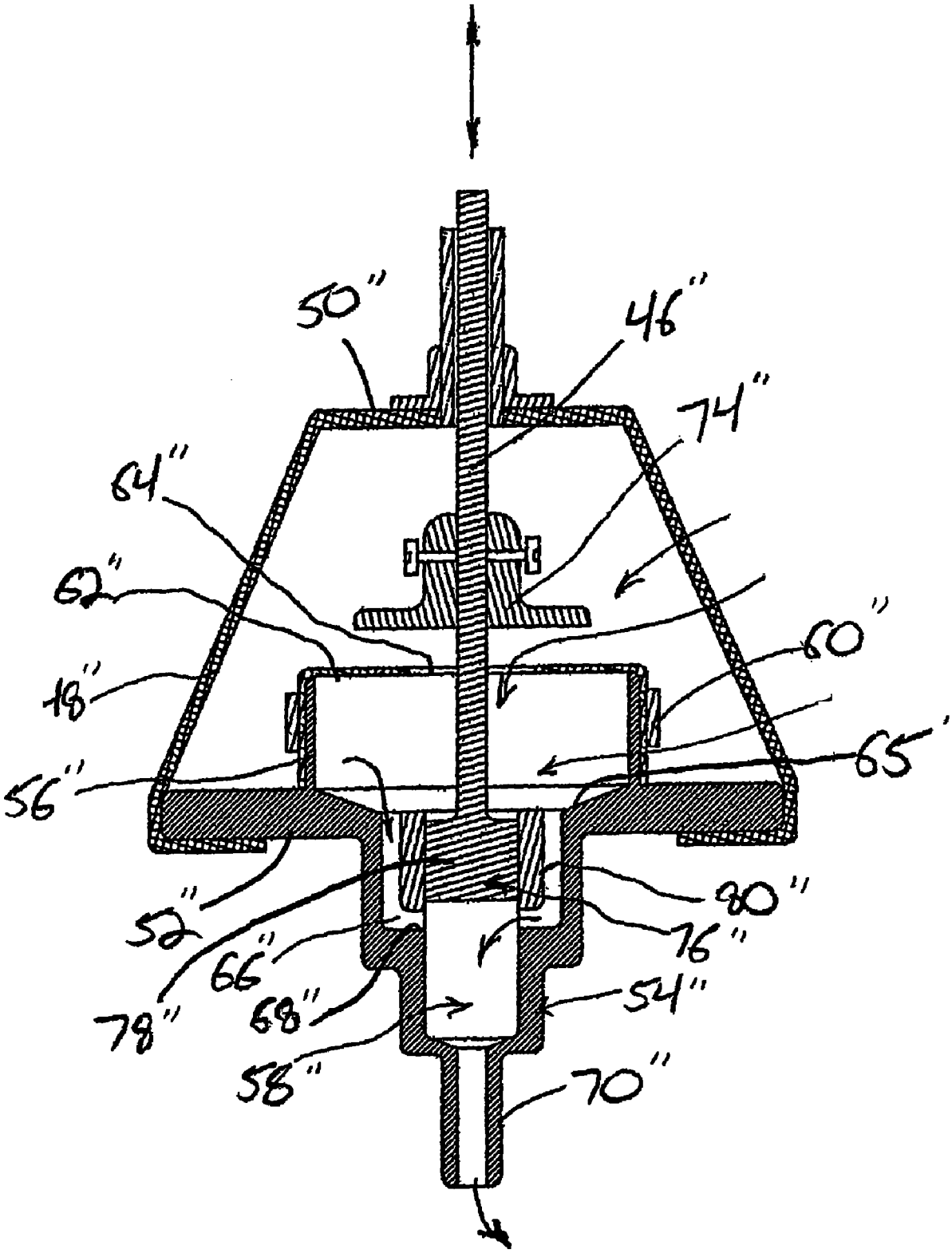
FIG. 2 is a cross-sectional view of a high pressure pumping mechanism of the apparatus of FIG. 1.
Figure 3:
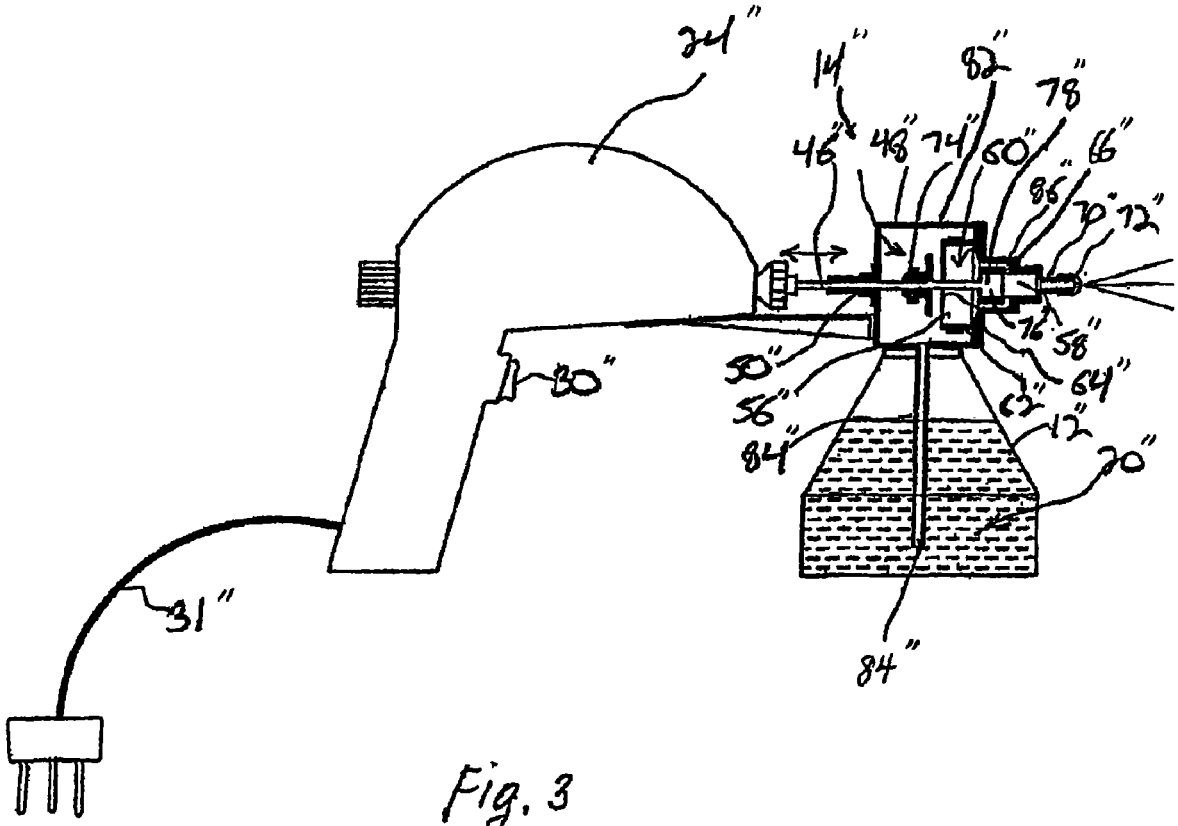
FIG. 3 is a cross-sectional view of a second embodiment of the mechanism of FIG. 2.

Turning now to FIGS. 2-6, a pumping mechanism 14 is illustrated in a number of varying embodiments. As best shown in FIGS. 2 and 3, in a preferred embodiment for the mechanism 14' or 14", the oscillating shaft 46' extends into a generally open housing 48' for the mechanism 14' that is submerged within the fluid 20' to be pumped. The housing 48' allows fluid to flow directly into the housing 48' and includes an upper end 50' through which the shaft 46' extends and a lower end 52' forming an outlet 54' of the mechanism 14'.

The lower end 52' includes an outlet member 56' secured to the housing 48' and that defines a central passage 58' extending therethrough. At an inlet end 60' of the passage 58', a flexible diaphragm 62' is secured over the inlet end 60' which defines an opening 64' at the center thereof. The opening 64' allows fluid flowing into the housing 48' to flow through the diaphragm opening 64' into the passage 58'. Below the diaphragm 62', the passage 58' includes a middle or central section 66 connected to the inlet end 60' by an inwardly sloping wall 65' and defining an annular shoulder 68 on the outlet member 56' opposite the inlet end 60' between the central section 66' and an outer end 70'. The shoulder 68' reduces the diameter of the central section 66' to enable the pressure of the fluid entering the central section 66' past the diaphragm 62' to be raised as it is directed from the central section 66' into the outlet end 70'. From the outlet end 70', the fluid is directed into a nozzle 72' for dispensing from the mechanism 14'. The nozzle 72' also has a reduced diameter from the outlet end 70' in order to further increase the pressure of the fluid exiting the mechanism 14'.

In order to move the fluid through the mechanism 14', the oscillating shaft 46' includes a pair of piston members 74' and 76' secured to the oscillating shaft 46'. The first piston member 74' is attached to the shaft 46' within the housing 48' adjacent the diaphragm 62' but outside of the outlet member 56'. As the shaft 46' oscillates, the first piston member 74' urges or pushes fluid through the opening 64' in the diaphragm 62' and ultimately contacts the diaphragm 62' closing the opening 64'. Due to the flexible nature of the diaphragm 62', the first piston member 74' flexes the diaphragm 62' inwardly, thereby imparting additional pressure on the fluid that is pushed through the opening 64' and into the inlet end 60' of the outlet member 56'.

The second piston member 76' is disposed inside of the outlet member 56' within the central section 66'. The second piston member 76' is formed of an enlarged portion 78' attached to or integrally formed with the end of the shaft 46' and is surrounded by a flexible ring 80' having a diameter greater than the diameter of the outlet end 70'. As the shaft 46' oscillates, the second piston member 76' urges fluid that has entered the outlet member 56' through the opening 64' in the diaphragm 62' from the inlet end 60' into the central section 66' and outlet end 70'. The flexible ring 80' of the second piston member 76' allows the second piston member 76' to sealingly engage the shoulder 68' separating the central section 66' from the outlet end 70' to further compress and urge the fluid into the outlet end 70' and through the nozzle 72'. The functioning of both of the piston members 74' and 76' provides a dual compression of the fluid within the outlet member 56', thereby increasing the pressure of the fluid 20' dispensed by the mechanism 14'.

Referring now to FIG. 3, in a second embodiment of the mechanism 14", the mechanism 14" is spaced from the fluid to be pumped such that the housing 48" is formed as an enclosed housing 82" from which extends an inlet tube 84" that is positionable within the container 12 holding the fluid 20. In addition, the central section 66" is formed to be coextensive with the outlet end 70" such that the second piston member 76" is formed solely of the enlarged portion 78" which has a diameter approximately equal to that of the central section 66" and outlet end 70". However, in this embodiment the outlet member 56" includes a pair of fluid channels 86" formed in the central section 66" that extend from the inlet end 60" to the outer end 70 "and allow for fluid communication between the inlet end 60" and outer end 70" around the enlarged portion 78". Thus, during oscillation of the shaft 46", fluid entering the inlet end 60" due to the compression of the first piston member 74" against the diaphragm 62" is urged through the fluid channels 86" and into the outlet end 70". Simultaneously, the movement of the second piston member 76" within the central section 66" forces the fluid into the outlet end 70" from the fluid channels 86" into the nozzle 72".

Figure 4:
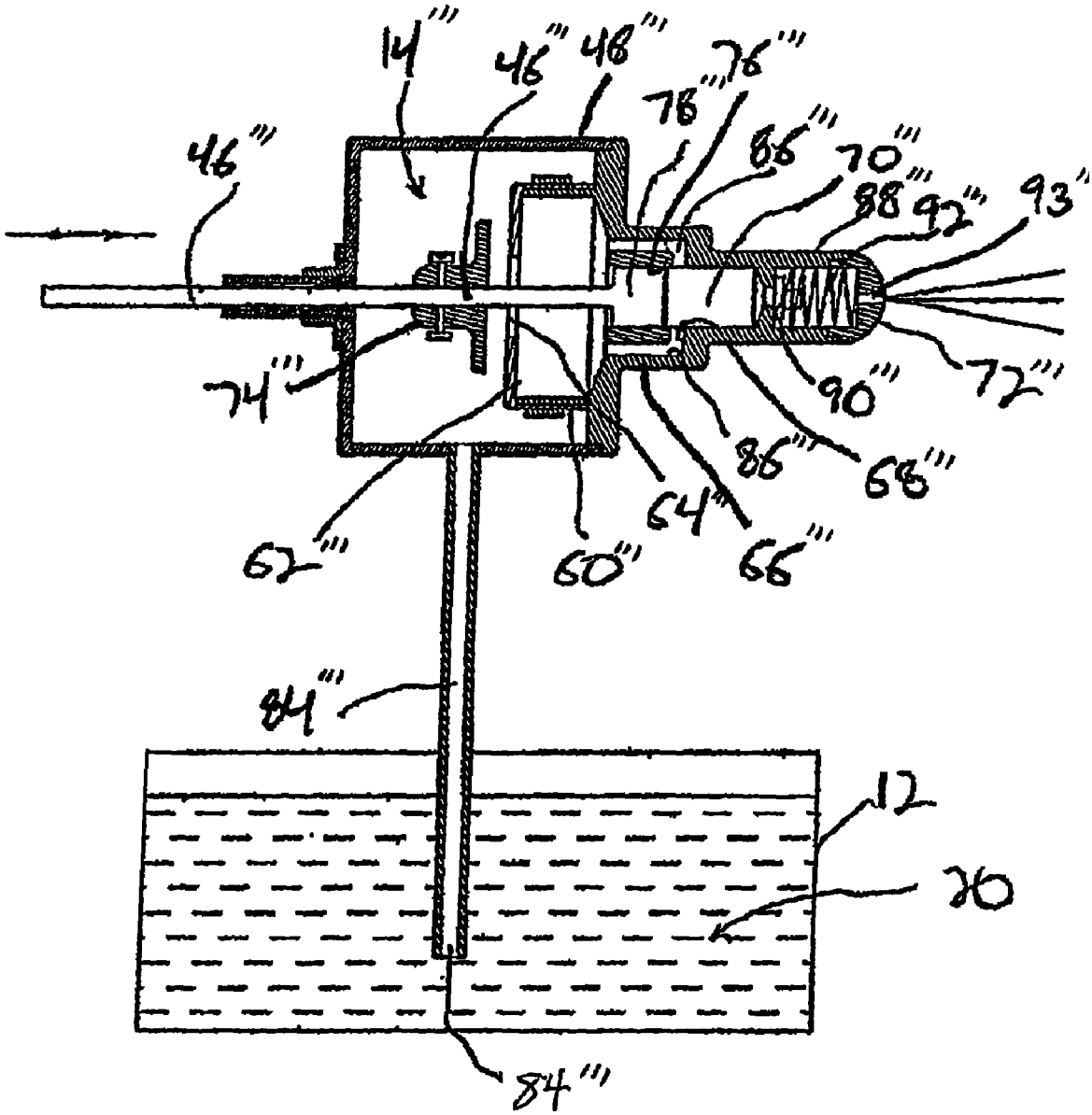
FIG. 4 is a cross-sectional view of a third embodiment of the mechanism of FIG. 2.

In a third embodiment of the mechanism 14''' shown in FIG. 4, the nozzle 72''' is formed with a plug 88''' disposed over a nozzle opening 90''' separating the nozzle 72''' from the outlet end 70'''. The plug 88''' is biased over the opening 90''' by a spring 92''' extending between the plug 88''' and the nozzle opening 93''' through which the fluid 20''' is ultimately dispensed from the mechanism 14'''. The spring 92''' selectively allows the plug 88''' to move away from the opening 90''' when the pressure of the fluid in the outlet end 70''' exceeds the bias of the spring 92'''. When a plug 88''' moves away from the opening 90''', the fluid can pass through the opening 90''' and through the nozzle 72'''.

Figure 5:
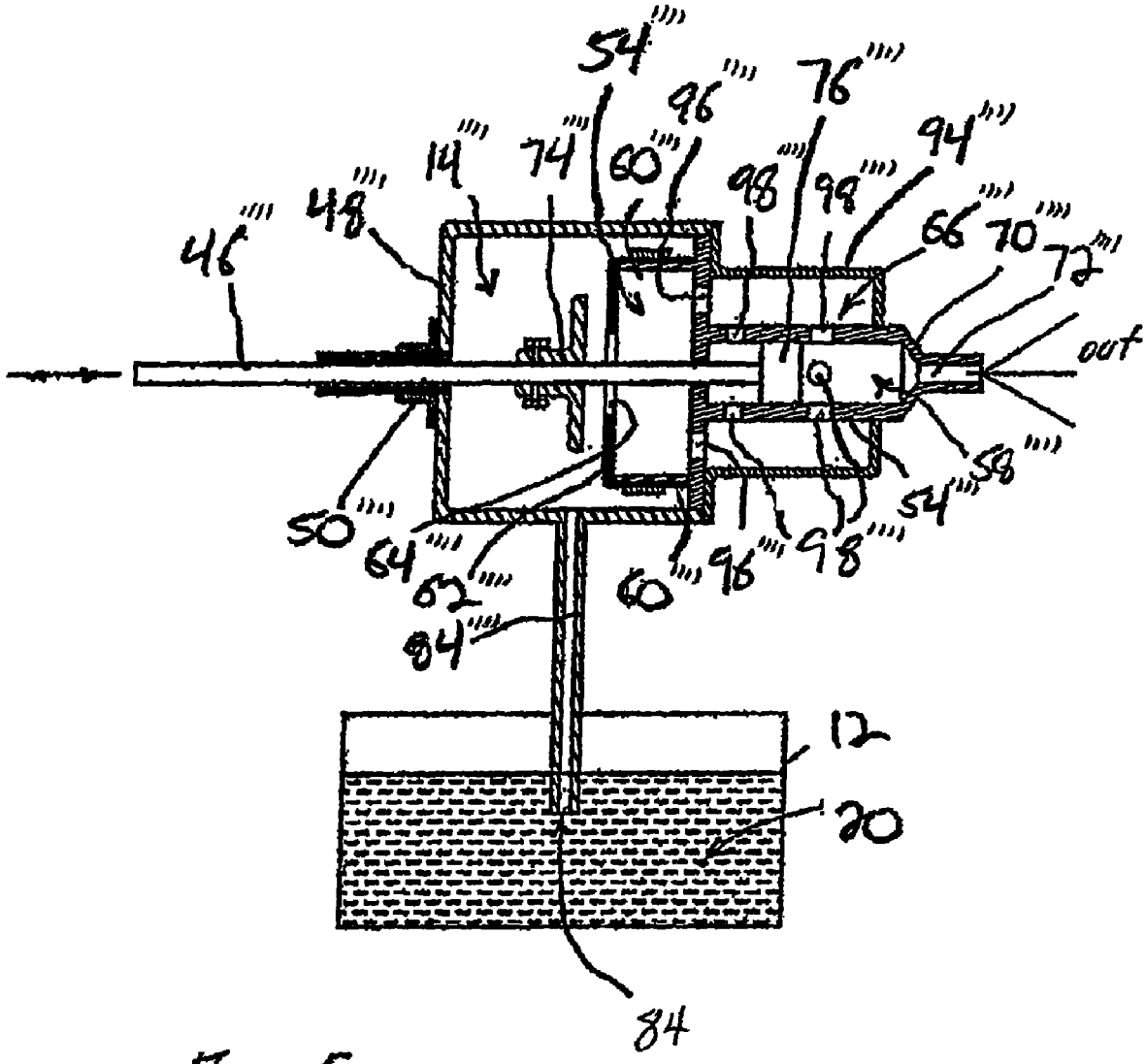
FIG. 5 is a cross-sectional view of a fourth embodiment of the mechanism of FIG. 2.

Referring now to FIG. 5, the fourth embodiment of the mechanism 14'''', the fluid channels 86" are replaced by a fluid housing 94'''' disposed around the central section 66'''' and outlet end 70'''' of the outlet member 56''''. The housing 94'''' is in fluid communication with the inlet end 60'''' and the outlet member 56'''' via openings 96'''' in the inlet end 60'''' and is in fluid communication with the central section 66'''' and outlet end 70'''' via openings 98''''. In operation, the first piston member 74'''' urges fluid past the diaphragm 62'''' into the inlet end 60'''' and through the openings 96'''' and into the fluid housing 94''''. Under pressure from the fluid moved into the inlet end 60'''' by the first piston member 74'''', fluid from the housing 94'''' passes through the openings 98'''' into the central section 66'''' or outlet end 70''''. Movement of the second piston member 76'''' toward the nozzle 72'''' urges fluid in the outlet end 70'''' forwardly through the nozzle 72''''. However, when the second piston member 76'''' is moved toward the central section 66'''', fluid is expelled from the central section 66'''' through the openings 98'''' into fluid housing 94'''' and is simultaneously drawn into the outlet end 70'''' from the fluid housing 94'''' via the openings 98''''.

Figure 6:
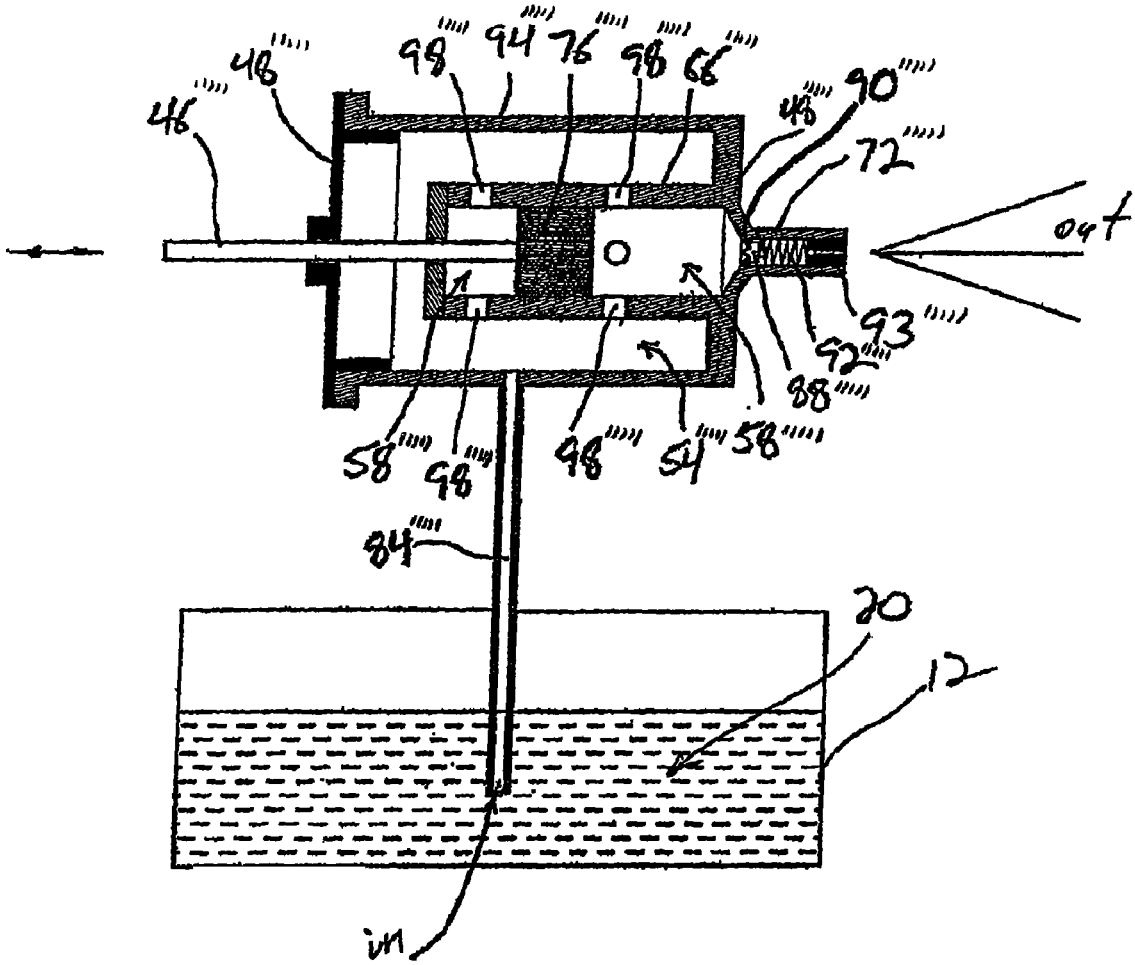
FIG. 6 is a cross-sectional view of a fifth embodiment of the mechanism of FIG. 2.

In a fifth embodiment of the mechanism 14''''' shown in FIG. 6, the mechanism 14''''' is formed only of the fluid housing 94''''' disposed around to a central section 66''''' and outlet end 70''''' of the outlet member 56''''' which includes openings 98''''' allowing fluid housing 94''''' to be in fluid communication with the central section 66''''' and outlet end 70'''''. An inlet tube 84''''' extends from the fluid housing 94''''' into a container 12''''' holding an amount of the fluid 20''''' to be dispensed by the mechanism 14''''' to supply fluid 20''''' to the mechanism 14'''''. The nozzle 72''''' includes a plug 88''''' disposed against a nozzle opening 90''''' by a spring 92'''''. As described previously, when the second piston member 76''''' compresses the fluid against the plug 88''''', the plug 88''''' moves against the bias of the spring 92''''' when a sufficient pressure in the fluid 20''''' has been reached to overcome the bias of the spring 92''''', thereby allowing the fluid to be dispensed through the nozzle opening 90''''' and out of the nozzle 72'''''.

Figure 7:
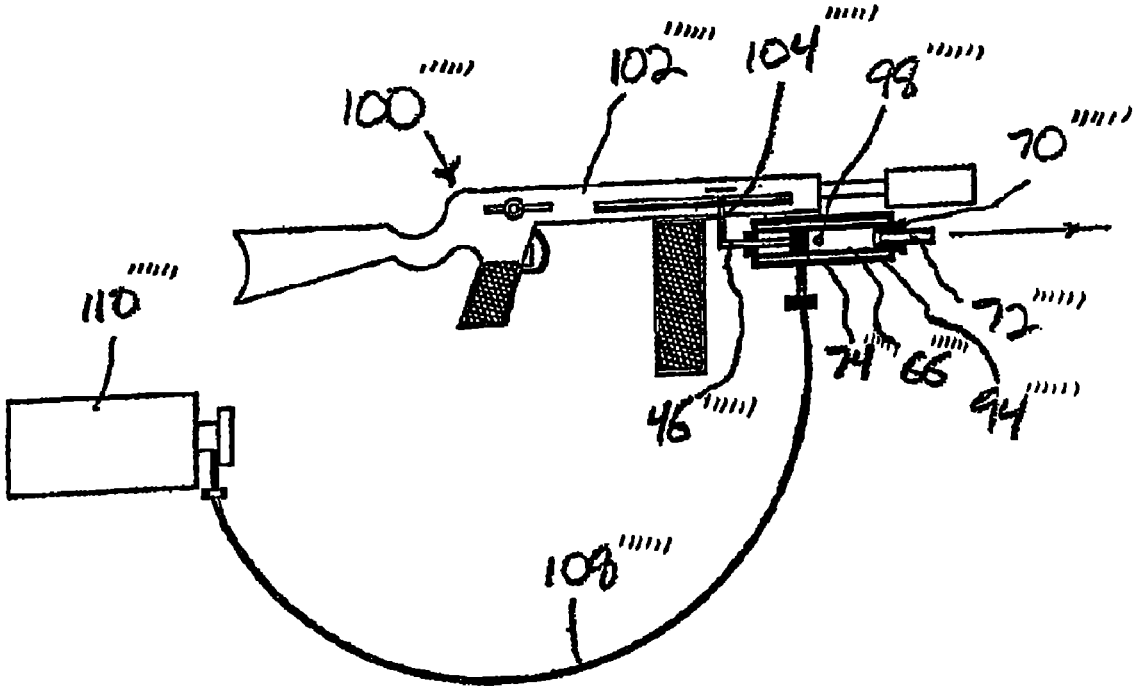
FIG. 7 is a side plan view of a sixth embodiment of the mechanism of FIG. 2.

In FIG. 7, a sixth embodiment of the mechanism 14''''' is illustrated in which the mechanism 14''''' is attached to a firearm 100'''''. The firearm 100''''' includes a modified fluid housing 94''''' secured to the barrel 102''''' of the firearm

100"""". The shaft 46"""" connected to an extension 104 extending from the barrel 102. The extension 104"""" is connected to an oscillating portion of the firearm 100"""", such as the firing pin (not shown), such that movement of the extension 104"""" caused by the firing of the firearm 100"""" also moves the shaft 46"""" in an oscillatory manner. This movement, in turn, causes the shaft 46"""" and first piston member 74"""" on the shaft 46"""" to draw a preferably combustible fluid into the housing 94"""" through a pipe 108"""" connected to a tank 110"""". The fluid is drawn into and discharged from the housing 94"""" in the manner previously described with regard to the embodiment of FIG. 6, such that the fluid is dispensed into contact with the projectiles (not shown) and combusted gases (not shown) exiting the firearm 100"""". The contact of the fluid with the projectiles and gases causes the fluid to ignite, such that the ignited fluid is sprayed in the direction the firearm 100"""" is pointed.

Various alternatives are contemplated as being within the scope of the following claims particularly pointing out and distinctly claiming the subject matter regarded as the invention.

We hereby claim:

1. A vibratory pump apparatus comprising:

a) a pumping mechanism including a vibratory oscillating shaft adapted to dispense a fluid disposed in fluid contact with the pumping mechanism; and b) an adapter operably connected to the oscillating shaft in the pumping mechanism and selectively engageable with a separate motive device to convert the motion of the motive device into oscillating motion for the shaft, wherein the pumping mechanism further comprises:

i) a first piston member disposed on the oscillating shaft within a housing for the mechanism; and ii) a second piston member disposed on the oscillating shaft and spaced on the oscillating shaft from the first piston member to move with the first piston member, wherein the second piston member is disposed within an outlet member of the mechanism separated from the housing by a flexible diaphragm having a central opening through which the shaft passes.

2. The apparatus of claim 1 wherein the adapter comprises:

a) a rotatable member engageable with the motive device; and b) a converting member connected between the rotatable member and the oscillating shaft.

3. The apparatus of claim 1 wherein the outlet member comprises:

a) an inner end having a first diameter;

b) a central portion having a second diameter; and c) outer end having a third diameter.

4. The apparatus of claim 3 wherein the second piston member comprises:

a) a first portion having a diameter equal to the outer end; and b) a second portion disposed circumferentially around the first portion.

5. The apparatus of claim 3 wherein the central portion and the outer end have equal diameters.

6. A pumping mechanism for a vibratory pump comprising:

a) a vibratory oscillating shaft adapted to dispense a fluid disposed in fluid contact with the pumping mechanism b) a first piston member disposed on the oscillating shaft within a housing for the mechanism; and c) a second piston member spaced from the first piston member, wherein the second piston member is disposed on the oscillating shaft and spaced on the oscillating shaft from the first piston member to move with the first piston member, and wherein the second piston member is disposed within an outlet member of the mechanism separated from the housing by a flexible diaphragm having a central opening through which the shaft passes.

7. The mechanism of claim 6 wherein the outlet member comprises:

a) an inner end having a first diameter;

b) a central portion having a second diameter; and c) outer end having a third diameter.

8. The mechanism of claim 7 wherein the second piston member comprises:

a) a first portion having a diameter equal to the outer end; and b) a second portion disposed circumferentially around the first portion.

9. The mechanism of claim 7 wherein the central portion and the outer end have equal diameters.

* * * * *